United States Patent [19]

Giess

[11] 4,391,077

[45] Jul. 5, 1983

[54] METHOD OF CONSTRUCTING A BUILDING SYSTEM

[75] Inventor: Hans J. Giess, Rotorua, New Zealand

[73] Assignee: Fletcher Timber Limited, Auckland, New Zealand

[21] Appl. No.: 283,144

[22] Filed: Jul. 14, 1981

Related U.S. Application Data

[63] Continuation of Ser. No. 100,976, Dec. 6, 1979, abandoned.

[30] Foreign Application Priority Data

Dec. 8, 1978 [NZ] New Zealand ..... 189128

[51] Int. Cl.[3] ..... E04B 1/10

[52] U.S. Cl. ..... 52/747; 52/233; 52/285; 52/585; 52/586

[58] Field of Search ..... 52/233, 585, 586, 271, 52/747; 46/20, 19, 26, 27

[56] References Cited

U.S. PATENT DOCUMENTS 2,225,612 12/1940 Allen ..... 52/586

2,392,551 1/1946 Roe ..... 52/586

OTHER PUBLICATIONS

American Builder, Feb. 1933, p. 33.

*Primary Examiner*—John E. Murtagh

*Attorney, Agent, or Firm*—Holman & Stern

[57] ABSTRACT

A method of building which uses lengthwise stackable plank-like members of various materials or configurations each of which has at least one wholly extending transverse hole which when included in the building structure aligns with a similar hole of the other plank-like components. Joining members are applied in holes with adjacent slots to initially hold components together and serve as guides for assembly. A measure of racking resistance is provided to the building by shear resisting members such as a dowel or the equivalent being driven from each subsequent plank-like component into the aligned hole of a previously located component, the abutment between the components ocurring prior to the location of the shear resisting member. Other related methods including the use of modularly spaced holes, some only of which are used for racking resistance are disclosed.

4 Claims, 71 Drawing Figures

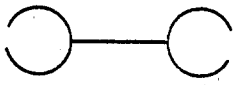
FIG 19
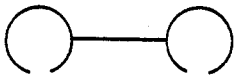
FIG 20
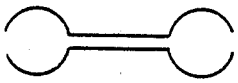
FIG 22
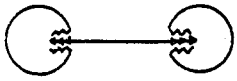
FIG 23
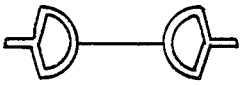
FIG 24
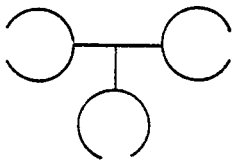
FIG 25
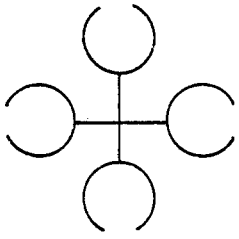
FIG 26
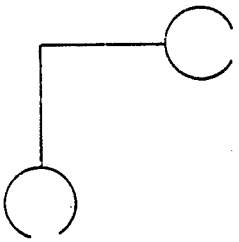
FIG 27
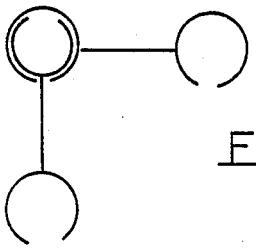
FIG 28
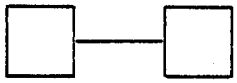
FIG 29
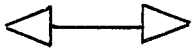
FIG 30
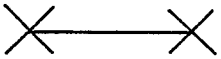
FIG 31
FIG 32
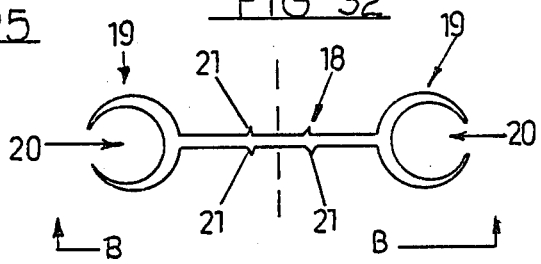
FIG 33
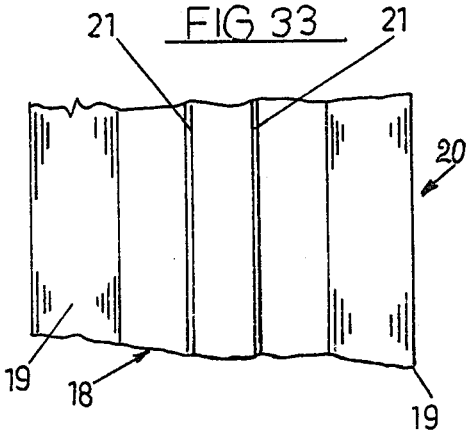

FIG. 34
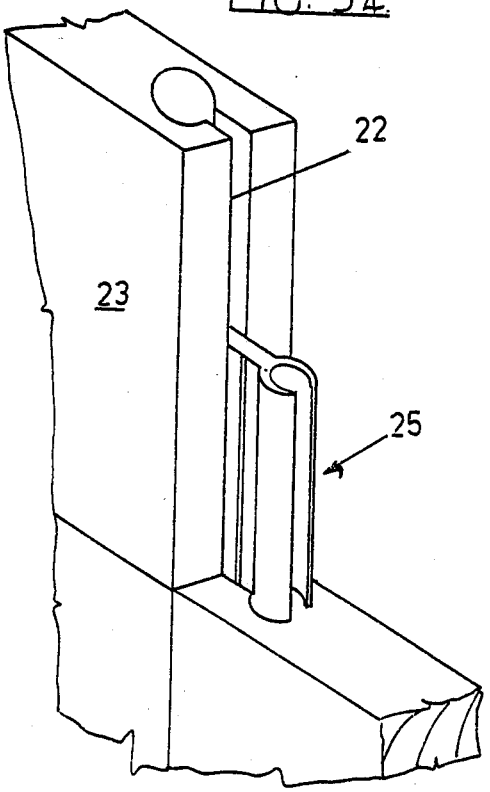
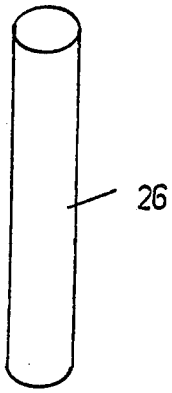
FIG 36A
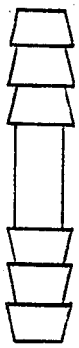
FIG. 36B
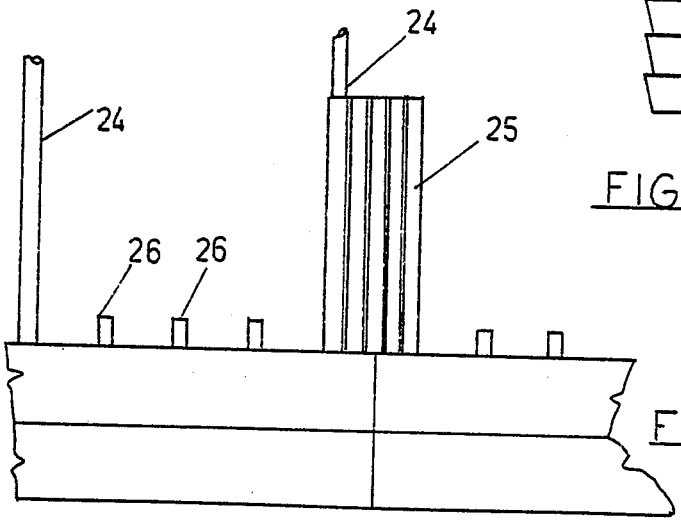
FIG. 35

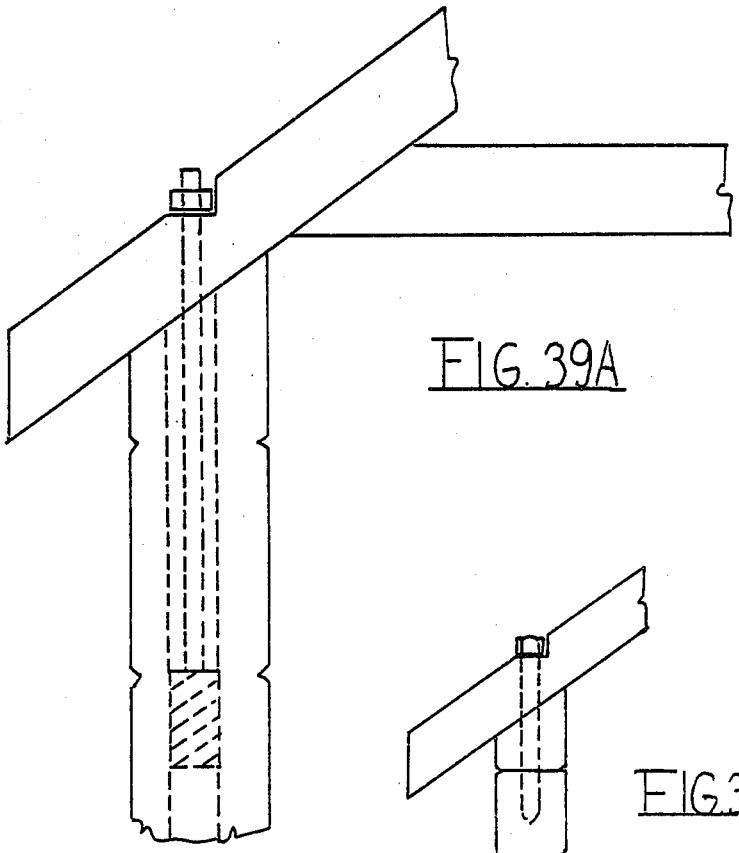
FIG. 39A
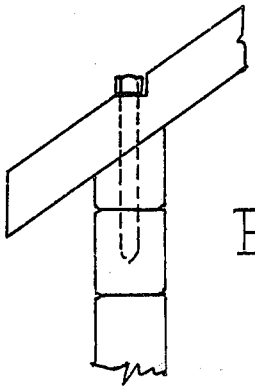
FIG. 39B
FIG. 40.
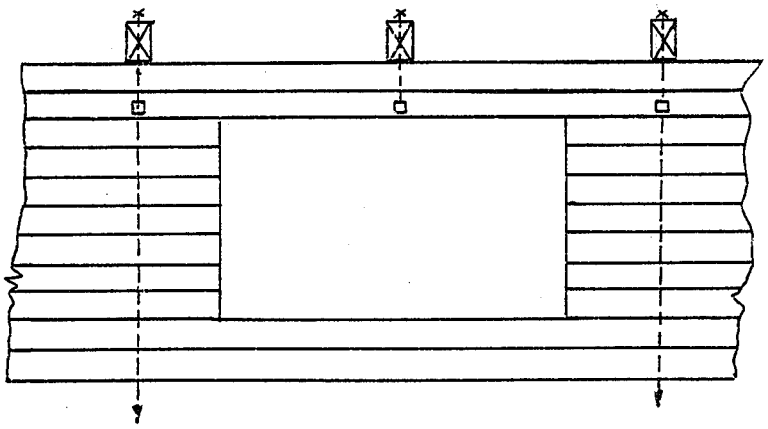

METHOD OF CONSTRUCTING A BUILDING SYSTEM

This is a continuation of application Ser. No. 06/100,976, filed Dec. 6, 1979, now abandoned.

DESCRIPTION OF THE PRIOR ART

1. Field of the Invention

This invention relates to a method of building structures having substantially planar walls from contiguous plank-like building components.

Many forms of building are known which embody the use of factory prepared lengths of timber or other material pre-cut or otherwise formed which can be overlayed lengthwise (normally in a tongue and groove relationship) in order to provide the walls without there being any need to provide external cladding or interior cladding. Such systems can be extended for use as sarking, floors and the like. Such systems however do require some other means if any structure erected thereby is to have the required resistance to racking or shear loads caused by load or sysmic forces without an excessive deflection. Moreover with existing systems the provision of power points, tie rods and plumbing facilities require either a degree of standardisation or individual planning or preparation which therefore means that should any particular home purchaser wish to have an additional power point considerable expensive is involved in providing the required channels through the wall structure as it is necessary at the factory stage to provide the required additional holes in the board that are to provide a particular wall so that the required conduit can carry the wire to such additional points can be defined.

With existing systems where lengths of timber are overlayed in order to define wall structures, sarking and floors no completely adequate system which lends itself to factory or site preparation have been devised which will overcome difficulties in connection with the need to provide conduits within the wall, connections between walls and the required resistance to deflection under racking loads. It is therefore an object of the present invention to provide means and/or methods which will go some way to meet the abovementioned needs and/or at least provide the public with a useful choice when using such lengthwise components for the manufacture of buildings such as domestic dwellings or indeed commercial and industrial structure including not only buildings per se but also such items as feed bins, tanks, pools, partitions, shelving, boxes, containers, etc.

2. Brief Summary of the Invention

In one aspect the invention consists in an essentially one component thick substantially planar structure of contiguous although not necessarily co-extensive aligned lengths of elongate plank-like building components, whether strictly timber or otherwise, wherein each such length has at least one fully extending transverse hole parallel to the plane of the planar structure aligned with a similar transverse hole of the proximate contiguous length or lengths having means providing a measure of resistance to racking loads on and deflections of the aligned lengths which comprises a non glued tight fit shear resisting member extending from within such a transverse hole of one length into the aligned hole of one contiguous length and not beyond. Preferably said lengths abut in a tongue and groove relationship. Preferably there is at least one non glued tight fit shear resisting member extending between each pair of abutted lengths within said structure. Preferably each of said lengths includes a plurality of transverse holes which are substantially mutually parallel extending therealong and the same are aligned with similarly positioned holes in the abutting length or lengths. Preferably said tight fit shear resisting member is a wooden dowel like member. Preferably the substantially planar structure is a wall which is engaged to at least one other substantially similar wall by means of an elongate connection member of substantially constant cross section which cross section includes a substantially straight shank and end regions of spread configuration each of which is slidably received in the adjoining wall structures by holes parallel to those receiving said tight fit shear resisting members and having a slot leading thereto to allow the positioning of the shank of said cross section there between. Preferably each of said lengths has a parallel hole in addition to those receiving tight fit shear resisting members which additional holes are aligned and receive a metal tie member to hold the structure in a tied relationship.

In a further aspect of the present invention consists in a method of construction of an essentially one component thick substantially planar structure of contiguous although not necessarily co-extensive aligned lengths of transversely holed elongate plank-like building components, whether strictly timber or otherwise, comprising the steps of locating a first length, bringing a second such length into a length-wise abutment with the located length so that the two lengths both lie with at least one fully extending transverse hole aligned with such a hole of the other, locating subsequent to such abutment a tight fit shear resisting member so that it extends in such aligned transverse holes between the two lengths, bringing a further length with at least one fully extending transverse hole into a lengthwise abutment with one of the first two lengths so that at least one transverse hole thereof aligns with such a hole of the other, the three lengths all having said transverse holes lying substantially in a plane, locating subsequent to such further abutment a tight fit shear resisting member so that it extends between the third length and the contiguous length with which it is in lengthwise abutment and so forth with further lengths, if any, to thus provide said one component thick substantially planar structure. Preferably each length has a plurality of parallel transverse holes and each length as it is brought into abutment is splined to another distinct structure, whether it be a post or wall, using one of the transverse holes, from which a slot extends to accomodate the shank regions of a spline having one end region slidably located in the slotted hole. Preferably each lengthwise abutment between lengths is a tongue and groove type engagement and preferably said shear resisting member is a wooden dowel. In some forms said shear resisting member is located within a length prior to its abutment lengthwise with another length and upon abutment is moved relative thereto to be located between the two abutting lengths.

In a further aspect the present invention consists in a method of erecting a wall structure comprising the steps of;

taking a plurality of length-wise stackable plank-like building components each with a plurality of wholly extending parallel transverse holes capable of being aligned with those of other of the components when stacked;

locating a first length by slidably splining the same to a mutual support component using one of the holes that has been slotted to allow the spline to locate in the hole;

bringing a second such length into a length-wise abutment with the located length while at the same time similarly splining the same and ensuring the plurality of holes align, locating subsequent to such abutment a tight fit shear resisting member so that it extends in such aligned transverse holes only between the abutting lengths, and similarly with further such lengths and shear resisting members until the wall is defined.

In still a further aspect the invention consists in a building having substantially one component thick planar structures, such as walls or sarking, of contiguous although not necessarily co-extensive aligned lengths of elongate plank-like building components, whether strictly timber or otherwise, wherein each such length has at least one fully extending transverse hole parallel to the plane of the planar structure aligned with a similar transverse hole of the proximate contiguous length or lengths having means providing a measure of resistence to racking loads on and deflections of the aligned lengths which comprises a non glued tight fit shear resisting member extending from within such a transverse hole of one length into the aligned hole of one contiguous length and not beyond.

Preferably any such lengths are part of a modularly holed and dimensioned system substantially as hereinafter described.

BRIEF DESCRIPTION OF THE SEVERAL VIEWS OF THE DRAWINGS

Preferred forms of the present invention will now be described with reference to the accompanying drawings in which;

FIGS. 19 to 31 show diagramatically various different kinds of spline connectors all of which are capable of being extruded from a metal or alternatively a plastics material, all of them including a shank and expanded end regions and the majority of them having expanded end regions substantially hollow so as to enable if desired the metal tie of the like to pass down through or if desired utilities to pass therethrough, FIG. 32 shows the preferred section of the spline connector in accordance with the present invention which has substantially circular expanded end regions which are open on the non load bearing regions thereof and which have on the shank regions thereof ridges adapted to fit the shank tightly into the cuts, such a configuration therefore by virtue of its substantial conforming to the holes between which it splines and the engagement of the shank ridges with components to be splined providing not only accurate locations and holding together of the components but also some degree of shear or racking resistance for the structure, FIG. 33 is a view BB of the section shown in FIG. 32, FIG. 34 shows in perspective a connecting spline of the kind shown in FIGS. 32 and 33 received within joints of timber of sections similar to that shown in FIG. 3, FIG. 35 is a side elevation view of such a butt joint showing the extrusion extending in its connecting mode upwardly and showing two tie members that extend upwardly through the wall structure, one of the tie members being shown passing through the open expanded end of the extruded spline connector, said figure also showing upwardly extending portions of the preferred shear resisting tight fit members, FIG. 36A shows the preferred form of tight fit shear resisting member which is preferably a wooden dowel of length such that the same projects in a tight fit manner into part only of each length of timber which has the same extending therebetween, (preferably non glued) after its being driven subsequent to the abutment of adjacent lengths of timber into its final position, FIG. 36B shows a variant of the configuration as shown in FIG. 36A, FIG. 39A shows diagramatically how a wall structure in accordance with the present invention can tie down and locate a rafter or truss even when a full wall height tie member is not used, the tie member being shown in FIG. 39A being for example a length of $\frac{3}{8}''$ diameter rod with an expanded head at its lower extremity with a coach screw thread which can be anchored down into some horizontal wall component and have the shank thereof pass up through the aligned holes thereof to thus anchor the rafter or truss with an appropriate washer and nut at the upper extremity, FIG. 39B is an alternative form which shows for example a full length bolt like screw screwed down into the aligned holes to tie a rafter or truss, FIG. 40 shows how even with the location of such rafters by for example the arrangement as shown in FIG. 39A those horizontal plank-like components which form part of the present invention can themselves be firmly anchored by fully extending tie rods to the foundation shown diagramatically at either end of the wall.

DETAILED DESCRIPTION

The system of the present invention is primarily designed for use in combining building components preferably formed for laying substantially horizontally in an overlying relationship so as to define wall structures. However persons skilled in the art will appreciate the building components in accordance with the present invention could be formed for laying at an angle to the horizontal and yet still embody some of the features of the present invention.

In still other forms of the invention a roof structure could be formed whereby while the longitudinal axis of the lengths of timber are inclined the holes that pass transversely thereto lie substantially horizontally. Moreover when used for partitions it would still be possible to provide instances where the holes that pass transversely thorugh the lengths of timber lie substantially horizontally, i.e. with the longitudinal axis of the lengths of timber lying substantially vertical. This may be a form that is appropriate for, for example, A-frame buildings which have steep inclined walls.

Figure 1A:
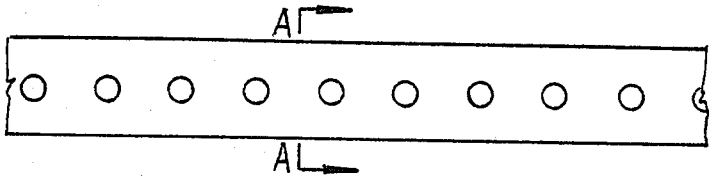
FIG. 1A is a view from above of a length of timber in accordance with one preferred form of the present invention showing holes that transversely pass therethrough to lie substantially parallel with the sides of a rectangular sectioned plank-like component which in use, if used for a wall, would have the holes lying in substantially a vertical direction, the holes themselves being mutually spaced apart at a constant predetermined modular distance of for example 50 mm.
Figure 1B:
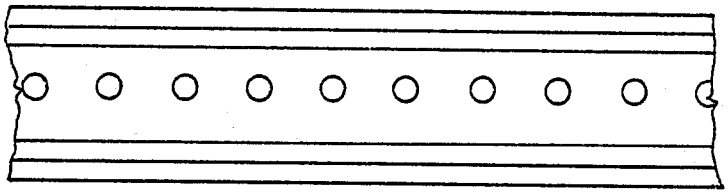
FIG. 1B is a similar profile to that of FIG. 1A but showing the appearance from above of a tongue profile of a kind substantially shown in FIG. 2.
Figure 2A:
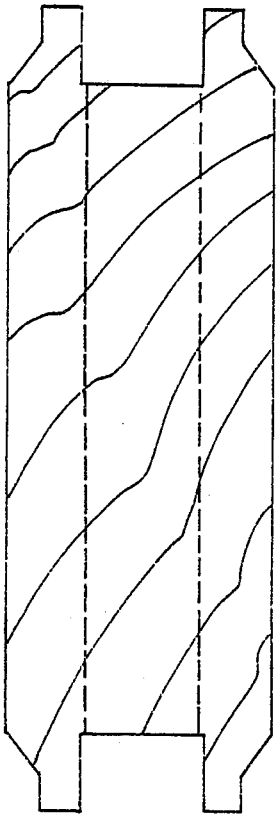
FIG. 2A is a section view AA of a length of timber but which has a profile shown in FIG. 1B and which is adapted for a tongue and groove arrangement, the dotted lines denoting the transverse extent of the holes that pass therethrough.
Figure 3:
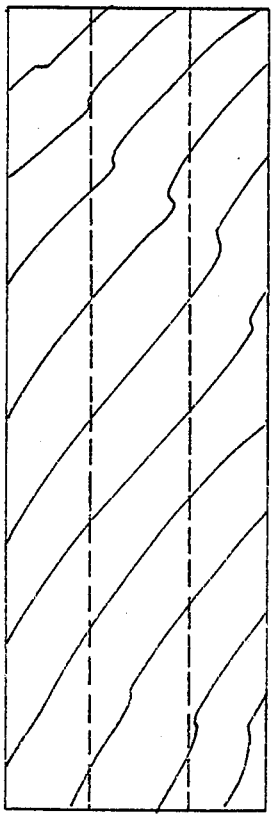
FIG. 3 is a sectional view AA of the profile of FIG. 1 with the dotted lines again showing the extent of the longitudinally spaced wholly extending transverse holes thereof.
Figure 2B:
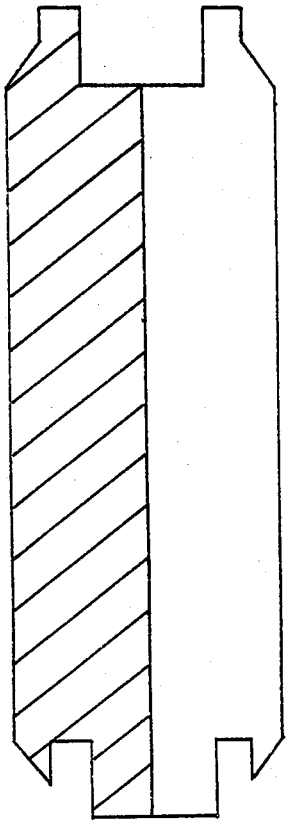
FIG. 2B is a variant of the profile of FIG. 2A and which for convenience does not show the dotted extent of the holes that would pass therethrough, the variant of FIG. 2B being one where common sized saw mill components are shown laminated to provide a profile substantially as shown in FIG. 2A, the use of such lamination being such that each part of the lamination will tend to counteract any warping characteristic of the other.
Figure 2C:
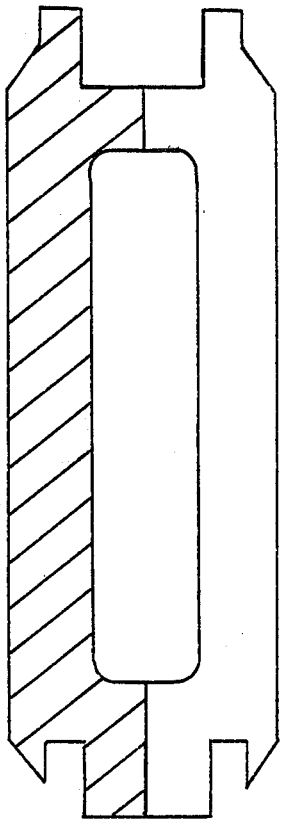
FIG. 2C is a similar view to that of FIG. 2B but showing a cavity type construction, the cavity either being left empty or being filled with for example a thermal insulating plastics material, for example polyurethane foam.
Figure 9A:
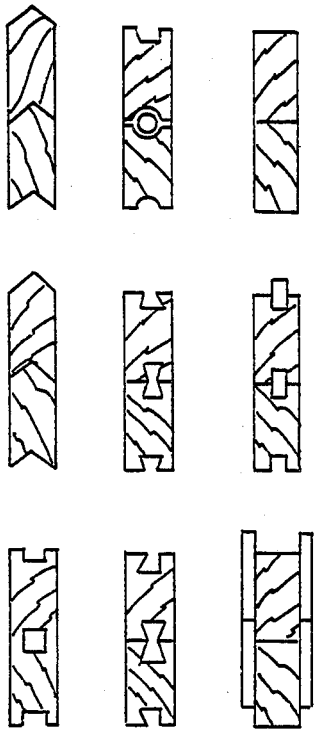
FIG. 9A shows sectional views of various overlying lengths of timber or other material showing various means whereby the same can be set one upon the other, with some of the forms showing modifications to a tongue and groove arrangement (for example using substantially horizontal spine members and the like) the preferred form however being those which do not include splines for this purpose as the provision of splines will interfere with passage of material whether it be shear resisting members, conduits, plumbing or electrical or the like down through any aligned holes.

Primarily however the preferred form of the building component is one such as shown in FIG. 1 where a plurality of holes 1 are provided which pass into and through a transverse section of the elongate building component. FIGS. 1A and 1B show two different profiles. Ideally the building component is formed from timber or other lightweight material and has a section as shown in FIG. 2A or some equivalent (such as FIGS. 2B and 2C) which allows an overlying tongue and groove type relationship which offers a weather seal, an aesthetic finish and also some resistance to deflection in a direction perpendicular to the vertical plane of the longitudinal axis thereof. In other forms of the present invention the length of timber or other material from which the building component is formed could be for example as shown in FIG. 3. With such a simple configuration some means could be necessary if such component was used for a wall exposed to the weather (especially in a residential building) to weather proof between joints e.g. butyl tape, mastic or the like. FIG. 9A shows various other configurations of the cross section that could aslo find favour. All of the preferred building components however do have one thing in common and that is the positioning of holes 1 (see the dotted lines in FIGS. 2 and 3 which show extent) which are spaced at a modular distance with respect to each other along the length of the timber. The splined profiles of FIG. 9A are not preferred where shear resistent members are to be inserted unless of course the spline is fixed and has the holes extending therethrough. In the preferred form of the present invention the centre to centre distance of the modularly spaced holes is 50 mm. Obviously however other forms of hole could be provided and the modular spacing could be quite different. In fact in some forms of the present invention it is envisaged that it may be appropriate to provide modular spacings between groups of holes, however, to give the greatest possible flexibility and reduce waste preferably the holes 1 are spaced evenly along the length of each building component and each passes completely through the major transverse dimension of the timber. Preferably the cross section of the lengths of timber is approximately 150 mm×50 mm.

In the preferred form of the present invention the holes 1 are circular owing to the fact that they are the easiest type of hole to form, thus making it possible to drill the holes by normal drilling.

Figure 6:
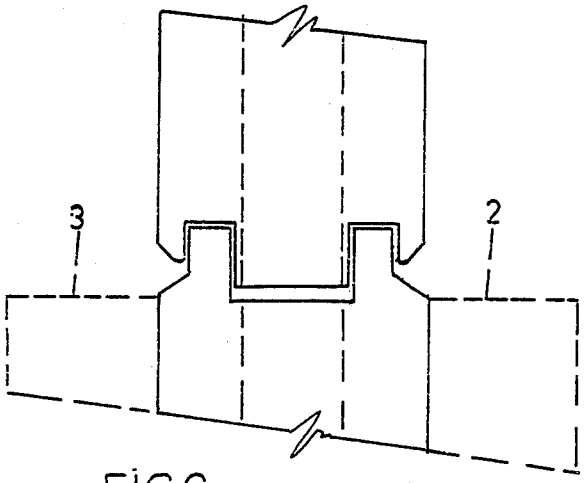
FIG. 6 is a similar view to that of FIG. 4 but with the additional dotted outlines showing possible extentions integral or fabricated to the section which would enable particular lengths of timber to be appropriately positioned within a wall structure so that the shoulder or shoulders can provide a bearing support for floor joists or other beem members, eg ceiling joists or roof rafters.
Figure 4:
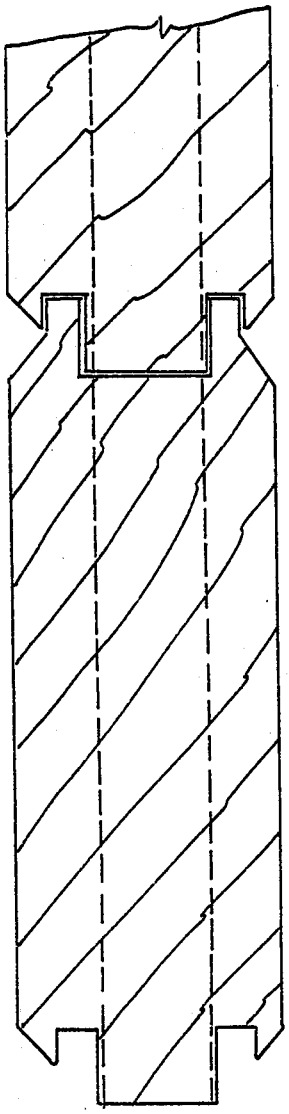
FIG. 4 shows the nature of the tongue and groove arrangement which results in the use of sections as shown in FIG. 2A and showing the nature of the aligned holes which permit the fitting therein of wiring or plumbing or expanded ends of an extruded spline member (provided there is an appropriate cut or slot), a roof, tie member or other metal tie member or a tight fit shear resisting member or members in accordance with the present invention.
Figure 5:
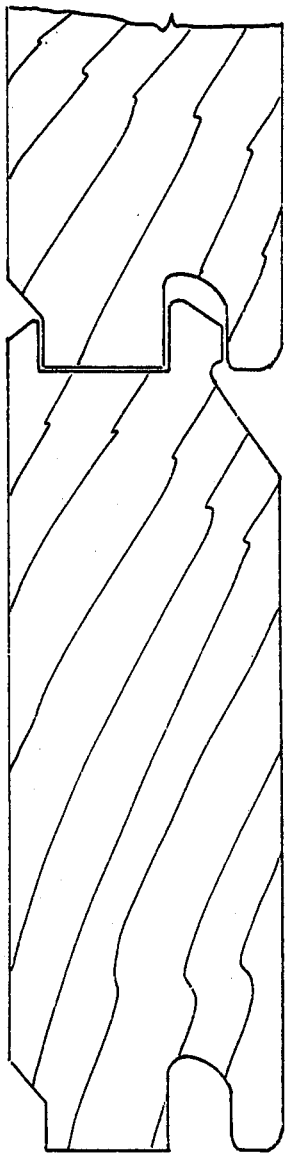
FIG. 5 is a similar view to that of FIG. 4 but showing alternative tongue and groove arrangements, suited for exterior walls, the right hand side being the weathering side of the structure.
Figure 9B:
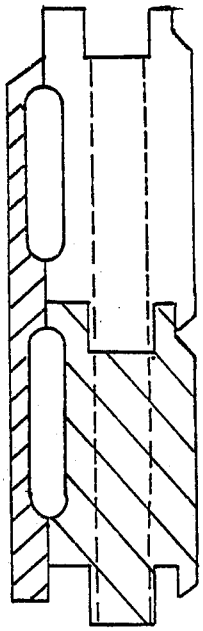
FIG. 9B shows how in some forms of the present invention the plank-like components in accordance with the present invention can not only be composite from a lamination point of view but can also be composite from an abutment engaging point of view (the term "plank-like" component as used throughout the present specification and the apended claims therefore including any such composite fabricated or the like component)

FIGS. 4 and 5 show the various tongue and groove engagements that would find favour. FIG. 4 shows one that is suitable for internal wall structures and also is suitable for external wall structures. FIG. 5 however shows a variation where there is a non-laminated version having a weather face (the right hand side of the drawing) and an inner face. However these variations are not an essential feature. In order to understand the present invention the dotted lines shown in FIGS. 4, 6 and 9B show the manner in which the holes 1 pass down neatly between the tongues and from and to a flat face, thus making drilling from either side relative easy. Moreover by having the holes positioned between two tongues it is possible to ensure the accurate alignment of the holes of the lengths of overlayed timber by simple end adjustment or by simply sliding down a tie (difficult), or spline member. Usually the fitting of each tight fit member resistant to shear provides progressive alignment of the layers.

FIG. 6 shows a variant of the type of arrangement shown in FIG. 4. However the concept shown by FIG. 6 has application to many other forms of configuration including the simple form shown in FIG. 3 and the other forms shown in FIG. 9. In FIG. 6 can be seen dotted projecting portions 2 and 3 which would be formed integrally with the length of timber 4 or alternatively could be glued or otherwise fitted thereto preferably at the factory precutting and preparation stage. One or both of the projecting portions 2 and 3 could be provided so as to define shoulders onto which floor joists or other beams or including even the ends of rafters or the like could rest. A person skilled in the art will appreciate how the use of a shoulder of a region 2 or 3 could support a member which is to be spline attached to a hole 1 of the aligned wall structure of which the section 4 forms but part.

Whatever profiles of the kinds herein are used in a building it can be seen that it is possible, for example, for a wall of one profile to butt against a wall (or posted wall) of another without a loss of hole modularity.

Figure 7A:
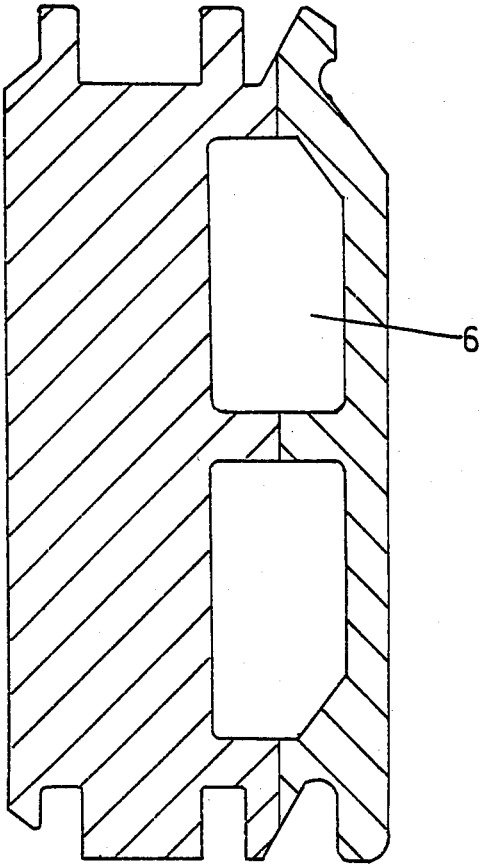
FIG. 7A is a further transverse section of a fabricated or laminated construction but which for convenience omits the dotted lines which show the whole extent of the transverse holes thereof, the particular section showing how a plurality of cavities could be defined which could be filled with for example insulating material for the purpose of heat insulation when incorporated in an exterior cladding.

FIG. 7A shows a further section (which does not include in dotted outline the central or substantially central positioning of the holes 1 for ease of explanation) which has on the weather face thereof a lamination (e.g. timber, particle board, asbestos-cement sheet, moulded plastic, metal or the like) which defines a cavity or cavities in order to minimise glue requirements when the same is fabricated (preferably at the factory stage) and also allow inclusion of insulation. Preferably the weathering member 5 includes in the hollowed out regions 6, some insulating material such as polyurethane, polystyrene, phenolic or urea foam. Preferably the material is polyurethane, such a foam making the system readily adaptable without a double wall structure or further attention for use in climates where heat loss or air conditioning is important.

Figure 7B:
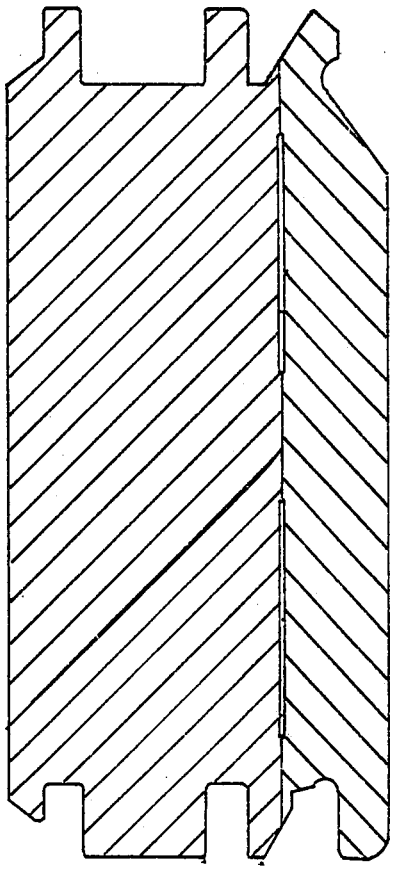
FIG. 7B is a similar view to that of FIG. 7A showing how if desired minimal cavities or no cavities at all need be provided even in such a profile of the composite construction and exterior outline of FIG. 7A.

FIG. 7B shows an alternative form to that of FIG. 7A like members being used to identify corresponding parts.

Figure 8:
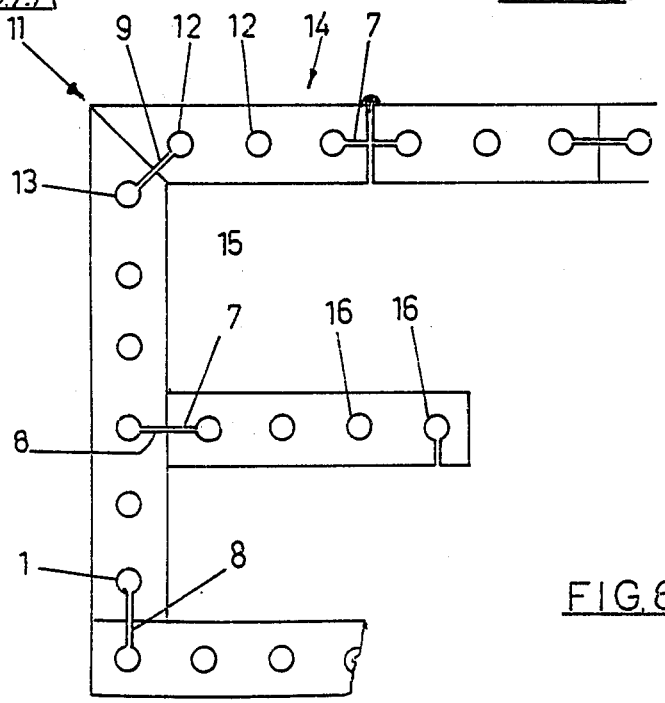
FIG. 8 is a plan view of the kind shown in FIG. 1 but showing various types of connections whereby cuts can be made to or arranged for appropriately positioned aligned holes of the overlying lengths of timber (or such other material from which the plank-like components may be formed) to provide butt joints of any of the kinds shown or a mitred joint as shown (the mitred joint not being the most preferred as it tends to lose the module of the construction as will hereinafter be discussed)

FIG. 8 shows in plan various lengths of timber of the kind shown in FIG. 1 showing the principal of the present invention. In FIG. 8 can be seen a series of different lengths (very much simplified for ease of explanation) where holes 1 of any particular length of timber are spaced evenly by the modular distance. Some of the holes that are to be connected by a spline connector as will be hereinafter described in more detail have a cut 7 (end cuts) 8 (side cuts) or 9 (mitre cuts) leading thereto adapted to locate firmly the shank of an extruded section which has a shank with at each end an expanded end slidably receivable within a hole 1. It can be seen however that if the connecting spline member is to have the expanded end regions receivable within a hole and the same is to maintain the module of the structure, the expanded ends of such a connector must be slidably receivable into adjacent holes spaced apart by the modular distance if in fact such holes had an appropriate cut passing therebetween. As can be seen however from FIG. 8 difficulties arise from the use of other than butt joints between an end or ends of the length of timber and/or a side face thereof. For instance the mitre joint shown generally as 11, obviously has the holes 12 and 13 that are connected by the aligned cuts 9 spaced apart by the modular distance, i.e. preferably 50 mm. However if the section of wall or the like structure 14 is to have the holes 12 thereof relate for example to one of the holes 16, it can be seen that such a relation is out of modular relationship with remainder of structure owing to the module being lost between the holes 12 and 13 that are connected at the mitre corner 11, owing to the angle at which the spline member must necessarily be received with respect to the remainder of the connections of the arrangement as shown in FIG. 8. If the effect of the mitred joint 11 is ignored it can be seen how the various side cuts 8 and end cuts 7 inter-relate to enable a series of different types of butt joint, i.e. some in line and others forming a T section, to be arranged in order to maintain the module throughout the building.

FIG. 9A shows several different sections of lengths of timber which could be embodied in a system in accordance with the present invention. Some of these systems are joined by horizontal splines, or the like. Others simply rely upon a modified form of tongue and groove, the inter engagement of a convex and concave (whether stepped or smoothly curved) suface or the like. All of these however do have some application within the scope of the present invention as each embodies one face to which the vertically extending modular holes in use could be parallel.

Figure 10:
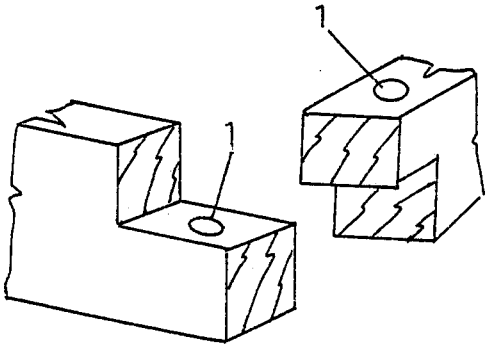
FIG. 10 is a perspective view of one means whereby ends of lengths of timber within a wall structure can be brought into a relationship whereby a tying member can tie wall structures together by the passing thereof down through the aligned holes in the corner without interfering with the module and leaving free a plurality of aligned holes for the purpose of carrying wiring or plumbing if any and of course shear resisting members in order to minimise deflections under racking or the like loads.

FIG. 10 shows how the most simple form of the present invention can be employed if it is desired to build a structure to hold same together at corners using upstanding ties. With such lapped cuts the holes 1 can be readily aligned so that the whole structure, for example for a shed, barn or the like can be simply held together by vertical ties. Thus the spline members could be used elsewhere for different forms of connection if desired. Obviously the shear resisting members of the present invention which will be described more fully hereinafter could also be used.

Figure 13:
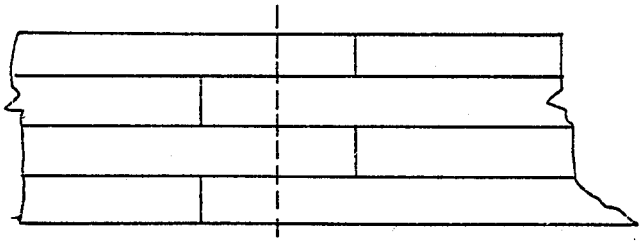
FIG. 13 is an arrangement whereby a tie in the direction shown by the dotted line can provide a located connection between butted wall sections which are substantially in the same plane without it being necessary to provide a spline member as will be hereinafter described, (a spline member or dowel or the like resisting member being viable alternatives to a tie for purposes of horizontal location)
Figure 12:
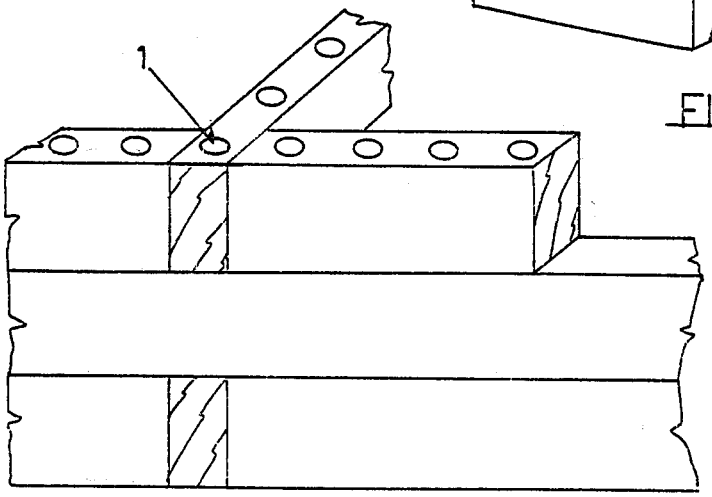
FIG. 12 is a variation of the arrangement shown in FIG. 11 whereby it is possible to have a partitioning wall or the like tied by a member in a simple manner from an exterior wall or vice versa.
Figure 11:
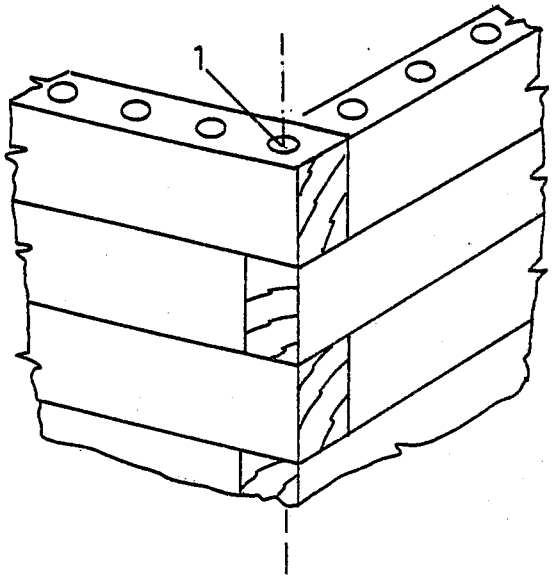
FIG. 11 shows an alternative to the form in FIG. 10 whereby lengths which are unmodified at the end (save for having the cut at the end position so as to preserve the modular inter relationship) can be stacked alternately to provide an alignment of holes at the corner whereby a tie member can pass down therethrough to not only locate the two walls relative to each other but also if desired tie a roof structure to the foundation from which the tie may originate.

FIG. 11 shows a different way whereby unmodified ends of a section shown in the top right of the figures contained within FIG. 9 could be arranged so that a tie member could tie aligned holes 1. FIG. 12 shows a different form of overlapping that would be appropriate. FIG. 13 shows yet a further simple form.

Figure 14:
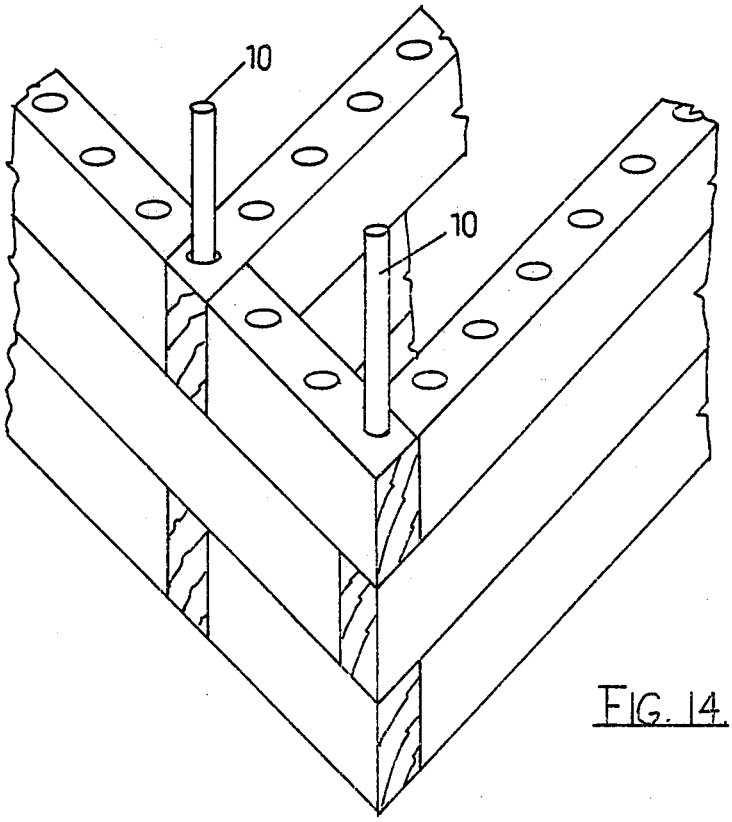
FIG. 14 shows in a perspective manner the arrangement shown in FIGS. 11 and 12 with portions of a metal tie extending upwardly out of the stack structure.
Figure 15:
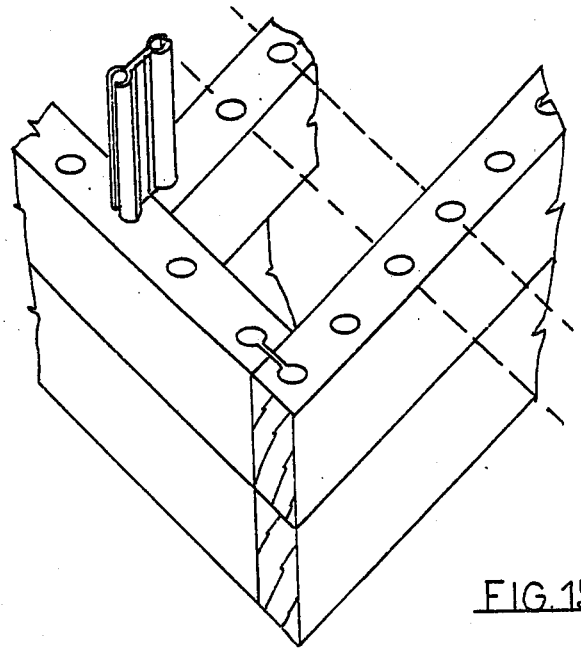
FIG. 15 is a similar view to that of FIG. 14 but showing instead spline members holding the three lots of wall structure together, only one of the spline members being shown extended above the upper layer of the structure and the dotted line showing how the modular inter relationship between the aligned hole of wall structures does not vary if in fact the module is preserved by judicious cutting with respect to the openings and the use of a connecting spline member whose expanded end regions are spaced sufficiently to preserve the modual also.

FIG. 14 shows in perspective metal ties or the like members 10 projecting from the uppermost of the holes from both of the kinds of arrangements shown in FIGS. 11 and 12. FIG. 15 shows in perspective a spline connecting member 17 in accordance with the present invention projecting from a structure formed in accordance with the present invention, said member having a shank and expanded end regions, each of with is receivable within aligned holes. Although not shown, a similar member to that designated 17 would protrude from the corner. The dotted line of FIG. 15 suggests how the modular relationship between holes of associated walls is lost if in fact the distance between the expanded ends is not such as to preserve the module.

Figure 16A:
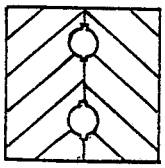
FIG. 16A is a composite section of one form of post which can be used so that the cuts can be taken into an appropriately positioned longitudinally extending hole thereof if a spline member is to be received therein to tie the same to either a wall structure or the like, any other hole if not being used within the post being suitable for the purpose of carrying conduits, tie members and the like, the section however as shown not being the most desired other than for stiffening purposes where it is not required to maintain the module as it would tend to result in the loss of the module throughout the building if such a structure is included as part of a wall.
Figure 16B:
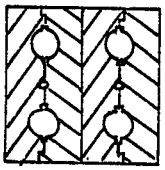
FIG. 16B is a composite section of a post which is preferred as it enables the preservation of the building module as the spacing of each hole from its nearest neighbours is the same distance as will exist between the holes along the length of the piece of timber, the distance of each hole from the nearest edge of the post being substantially half the modular distance so that the same combines readily with the end of the length of timber which has had the end cut thereof positioned substantially half way between adjacent holes on the length of the timber or the distance from each hole of the length of timber to its transverse edge is approximately half the modular distance so that the same is spaced in the modular manner from a post butted thereagainst or the end cut of a similar length of timber.
Figure 18:
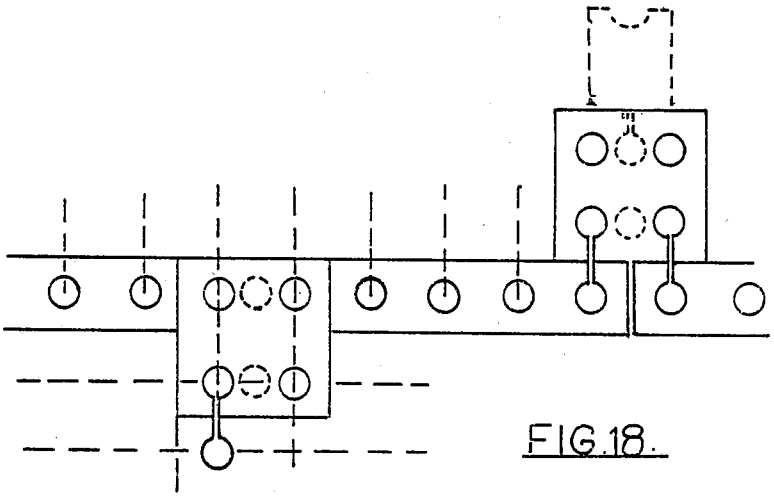
FIG. 18 shows in dotted outline how the module can be preserved with various configurations using a post of the sections shown in FIG. 16B, the various spline members being shown located in appropriate holes, the figure also showing with dotted additional holes how a post of section as shown in FIG. 17A does not interefere with the module but can allow if desired the taking off of a wall or the like from the post at a position centrally of the post.
Figure 17B:
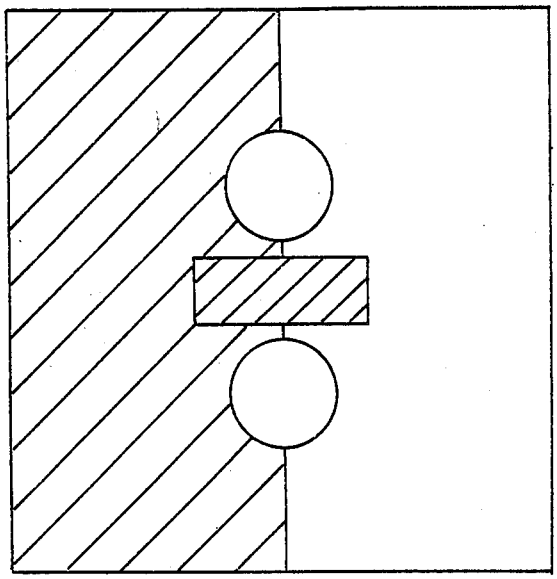
FIG. 17B is a variant of configuration as shown in FIG. 16A showing how if considered desirable the two component parts of the fabricated structure can be splined together.
Figure 17A:
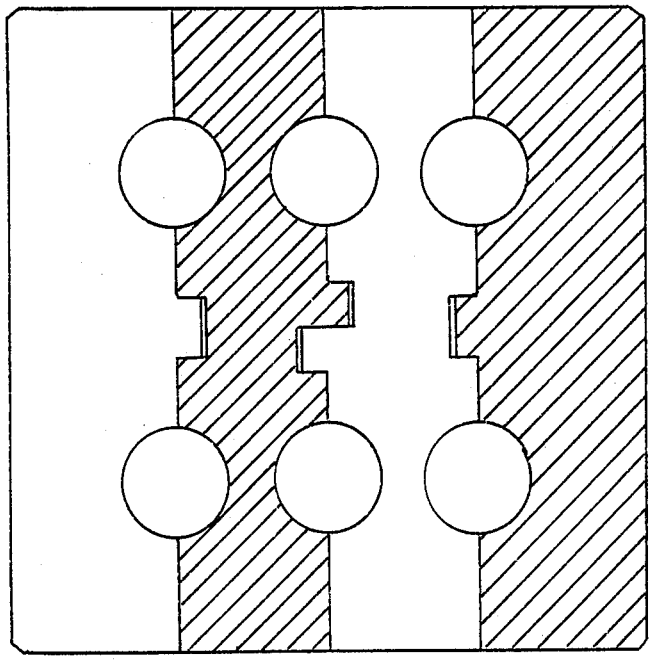
FIG. 17A is a further variant of the four hole module preserving configuration of FIG. 16B showing an additional pair of holes located between those pairs for the purpose as will become evident from a consideration of FIG. 18 hereinafter.

FIG. 16A shows the cross section of one post section. The distance between each hole and the nearest face would preferably be half the modular distance if in fact such posts are to be used with lengths of timber which have the cuts to be associated therewith effected by extending from a hole to the abutment face at the same distance or vice versa. If such an arrangement is not used then obviously careful matching of connecting members would otherwise be necessary. It is anticipated however that the length of timber whether they be provided with tongues and grooves or not be double sided in the sense that each side bears a similar relationship to the holes that pass substantially parallel therebetween. In the most preferred form of the present invention both sides are parallel to the holes that pass therethrough and if the modular distances i.e. the space in between the holes is considered as X then obviously it is desirable that end cuts be at a distance which will mate with the hole to side face distance so as to be engaged with spline member which has the expanded ends thereof spaced apart by a distance of substantially X. Such a spline joint in the preferred form of the present invention need not be a tight fit save for aesthetic reasons. Having regard to the fact that structural strength derives primarily from the combination of tongue and groove relationship between planks and boards if there is such a tongue and groove relationship the fitting of the dowels (and/or the spline members in a low load situation) as the structure is being erected, and the provision of tie rods, thus making each wall more unitary in characteristic. It is envisaged however that if the modular distance i.e. the hole spacing is X then the distance from an end hole to an end is either ($\frac{1}{2}$X) or ($\frac{1}{2}$X+A) or ($\frac{1}{2}$X−A) and the spacing of substantially all of the holes to the parallel side or preferably to both sides is ($\frac{1}{2}$X), ($\frac{1}{2}$X−A) or ($\frac{1}{2}$X+A) respectively. Obviously such measurements are not necessarily accurate bearing in mind the fact that a small gap should be provided to allow fitting, for example therefore consider the gap between either a staight or T-section butt joint as $\phi$ then any of the distances ($\frac{1}{2}$X), ($\frac{1}{2}$X+A) or ($\frac{1}{2}$X−A) can vary by some proportion of all of $\phi$. Obviously, however in the preferred form of the present invention the holes would be regularly spaced along a length of timber in order to save wastage and also to enable on site cutting, slotting etc. Of course the timber would be double sided again to save wastage and difficulties in fabrication. The post according to the arrangement as shown in FIG. 16B is preferred over that of FIG. 16A where the module must be carried through. With such an arrangement preferably each hole is again the same half modular distance from each near face, i.e. each of the two nearest faces. FIGS. 17A and 17B show additional forms. That of FIG. 17B is a splined version of that of FIG. 16A while that of 17A has six holes to enable (see FIG. 18) the posted connection of right angled walls. With such arrangements any of the configurations as shown in FIG. 18 can be used. A person skilled in the art will appreciate the modular inter-relationship between the various types of members determinable therefrom.

FIGS. 19 to 31 show diagramatically various sections of extrudable members that are capable of being used as spline connector members in accordance with the present invention. Each has a shank and expanded ends at each end thereof. Obviously some of the members as shown are composite members. Others are more complicated in that dependent from the shank thereof are other regions all of which would have some application. Obviously however care should be taken to maintain the module when used. A majority of the sections it will be noted include open expanded ends. This is for ease of extrusion, the saving of material and takes into account the only fully stressed region of the expanded ends is that portion thereof which will be most closely adjacent to the connecting region with the shank.

The preferred section is that shown in FIG. 32 and which is shown sideways by FIG. 33 in the direction BB denoted on FIG. 32. Shown by the broken line in FIG. 32 is the axis of symmetry with the shank 18 and the expanded ends 19 bearing an identical mirror like relationship thereto. Shown in FIGS. 32 and 33 are ridges 21 adapted to ensure a tight yet axially slidable non rattling fit in the aligned cuts of the members to be connected. Also shown is the open region (preferably outwardly) of each expanded end 19. It can be seen that utilities, tie rods or the like could easily be slid upwardly through the open sectioned expanded ends. As can be seen it is desirable to have an expanded end that locates recipricably in the modular holes as it is desired to be able to slide fit one expanded end into a length of timber or aligned lengths of timber and for the shank to be correctly indexed so that the same can have a normally cut piece of timber that is to be associated therewith readily engaged with the other expanded end 19 without the need for wrestling with the inclination or position of the extruded spline connecting member.

The shape of the expanded ends and the ridges 21 provide a good measure of rigidity to a structure as well as good component location.

Preferably the spline connector in accordance with the present invention is formed from aluminium. Other forms can be formed from other materials e.g. that of FIG. 22 would be spot welded galvanised steel. Other materials include plastics material.

FIG. 34 shows in perspective a length of timber 33 that has had shank region of a spline connector as shown in FIGS. 32 and 33 fitted there into. The shank of course lies reproducibly within the cut 22 of the length of timber 23. Obviously also as can be seen the connector 25 passes down into lowermost layers. In use of course that spline member would continue upwardly to locate any further layers of timber to be placed on the structure shown in FIG. 34.

FIG. 35 shows the side elevation of a wall structure (reference 23 being used to denote the type of length of timber as shown in FIG. 34) having the spline connector extending upwardly. Such a structure shows metal ties, preferably steel, 24 that can extend up through aligned holes of the wall structure or through an expanded end of a spline connector 25. Such ties tie the foundation to the wall structure and the roof as well as tie the components of the wall together.

One aspect of the present invention that is of considerably importance is the resistance to racking and the possibility of preassembly and FIG. 36A shows a preferred shear resisting member which is capable of a tight fit relationship with a hole of each length of timber. Preferably these members are formed from wood though some other material such as plastic, (see for example FIG. 36B for a suitable profile) aluminium or the like can be used. With a wooden dowel of short length (preferably of FIG. 36A configuration) it is possible to lay each length of timber 23 and locate the same as required with ties, spline members 25 or the like and to drive members 26 as required so that they span between adjacent planks, lengths of timber or the like 23 through the aligned holes thereon. Preferably the shear resisting members are not of such a length, such that the same in use span more than about the full vertical transverse section of a length of timber 23. It is envisaged in used that an appropriate number of members 26 would be hammered in, pressed in or otherwise located in the structure being erected to provide the required resistance to racking.

Of course the posts as shown in FIGS. 16A, 16B, 17A and 17B cannot be prepared simply by drilling owing to their great length and for this purpose ideally the same are formed as composite members in a technique defining conduits as has been use for example in hollow mast construction.

Figure 37:
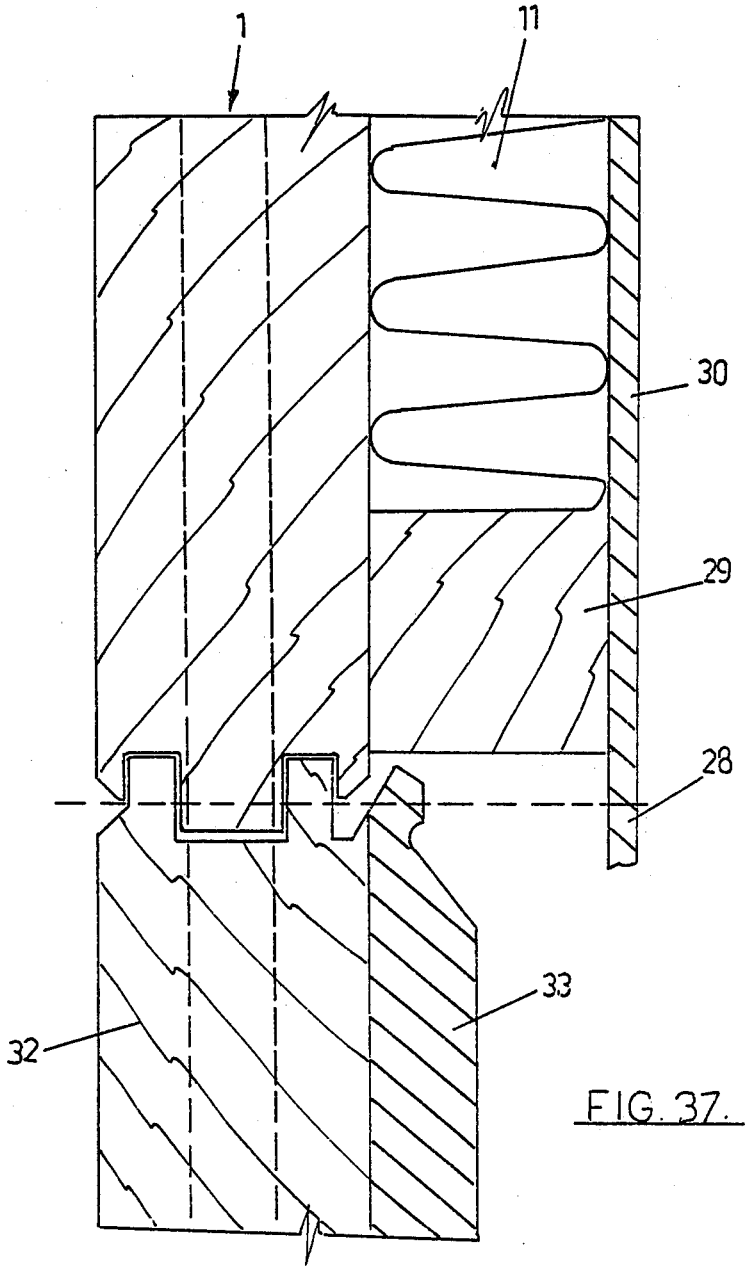
FIG. 37 shows a section of an exterior wall, the exterior face being on the right with a dotted line showing the ceiling level and the portion thereabove being a wall section of a gabled end region showing how the same can have a cladding sheet mounted thereon over a spacer and insulation yet at the same time the overlying lengths of timber can have in the aligned holes the metal ties, spline members and/or shear resisting tight fit members, it being realized of course the different profiles as previously shown are adapted to being substantially interchangeable to provide some degree of flexibility in design and appearance of a structure.

FIG. 37 shows with the horizontal dotted line 28 a ceiling level and shows how an alignment of holes 1 can persist thereabove especially at gables ends and how an internal board can be made to fit an exterior board if required. A packing member or the like 29 could be provided to locate a gable cladding face 30, under which can be positioned some appropriate insulating material or the like 31 if deemed necessary. Shown in FIG. 37 also is a cladding material which is preferably factory attached to basic timber component 32. The cladding 33 can be of any appropriate material but is preferably formed from a factory treated timber.

FIG. 38 shows in detail a sill ceiling joist connection and a rafter sarking detail. The alignment of the holes of the wall structure are not shown nor is the preferred tongue and groove arrangement. Persons skilled in the art will appreciate however how the same relates to, for example the sill arrangement shown diagramatically in dotted outline in FIG. 6 of the drawing.

Figure 38B:
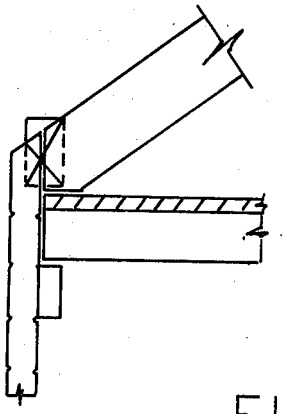
FIG. 38B shows in more detail but without showing the splining of the ceiling joists how a rafter can be splined into a wall (for this purpose a short length spline member preferably having a section as shown in FIG. 32 is shown in dotted outline)
Figure 21:
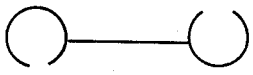
Figure 38A:
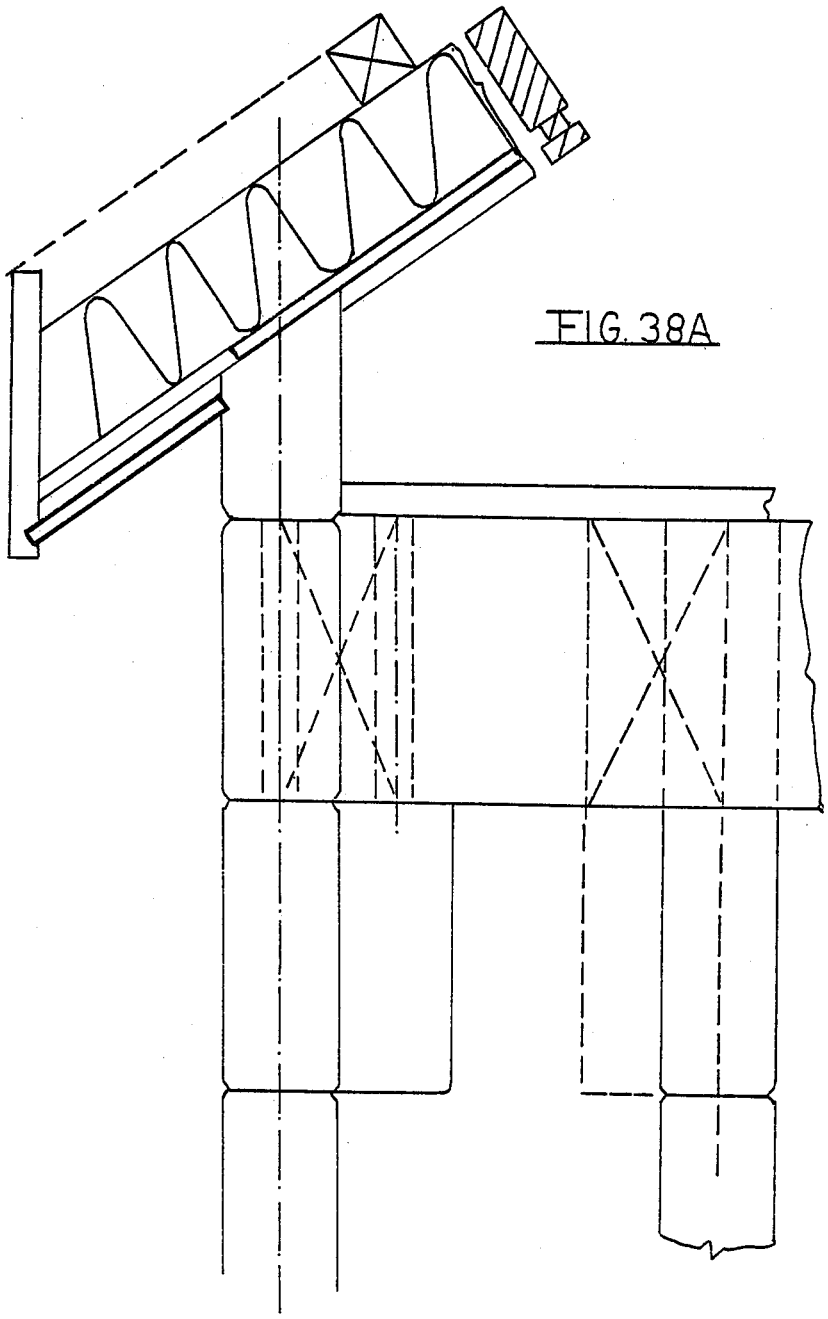
FIG. 38A shows a diagramatical view of a wall structure showing a sill ceiling joist connection and a rafter, sarking and soffit arrangement, the ceiling beam member having a hole or holes thereof splined in the normal manner (shown figuratively by the various dotted outlines) to a preferred single vertical width of a component of the wall and having the same resting on a sill or the like portion, for example as described with reference to dotted outlines in FIG. 6, FIG. 38A also showing diagramatically in a third angle projection the section of, for example, an appropriate rafter member having appropriate recesses for receiving cladding sheets or the like for a soffit and sarking (of course in alternative forms the sarking could be formed using profiles in accordance with the present invention)

In FIG. 38A can be seen a ceiling beam which is shown spline fitted to an exterior wall, the spline having been shown diagramatically. The figure also shows in third angled projection a sectioned view of the rafter. The soffit lining and sarking is shown in a solid band for ease of explanation and shown skeletally thereabove is a layer of insulation and roofing battens that would bear any conventional cladding. The actual ceiling beams shown, which could if desired be splined to internal walls (shown in FIG. 38A diagramatically) could themselves be clad by ceiling linings and left exposed together with the sills for aesthetic purposes.

FIG. 38B shows a similar view to that of FIG. 38A but shows how a spline (in dotted outline) could be used to spline a rafter into the wall ideally (not shown) down into the floor joist. For this purpose therefore it is envisaged that a spline of approximately twice a plank height would be used so that the same member splines not only the rafter to the wall but also the joist to the wall thus also providing some degree of inter engagement between the joists and the rafter. For the purpose of splining the rafter a hole at an angle other than strictly transverse would be necessary.

FIG. 39A shows how a rafter can be tied down into a wall structure where a full length tie member from foundation to rafter is not used. In this form of tying a metal member with an enlarged lower end would be provided with an appropriate coach screw thread which allows the same to be screwed down into one of the uppermost plank-like members and have the upstanding shank thereof passed through subsequently positioned plank-like members (if any) and eventually passed through the rafter and receive a washer and nut thereon. An alternative form to that shown in FIG. 39A is that shown in FIG. 39B where a straight threaded member could be screwed down through the rafter into one or a plurality (2 as shown) elongate members that form part of the wall structure.

FIG. 40 shows how a fixing system as shown in FIGS. 39A and 39B can if desired be used in conjunction with a full length tie, the dotted arrows denoting a full length tie as an alternative to the forms of tie shown in solid outline in the wall structure of FIG. 40, showing for example how a limited tie of the kind shown in FIG. 39A is appropriate above for example a window.

Figure 41:
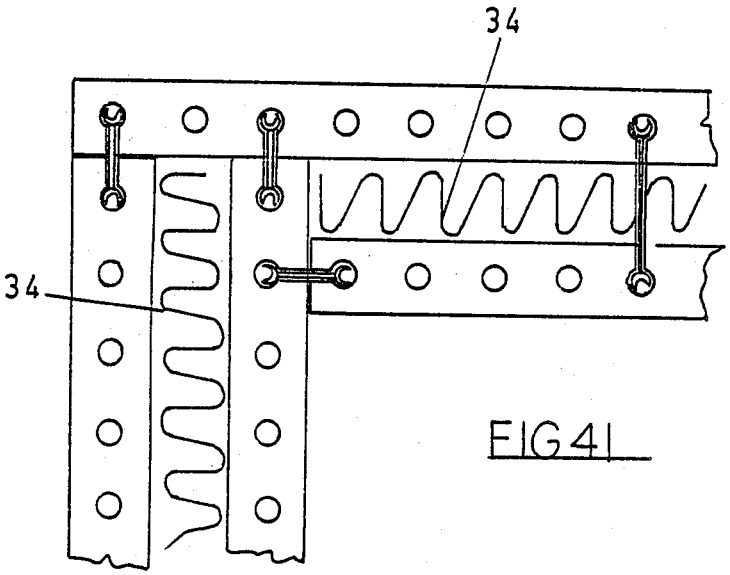
FIG. 41 is a view of connected wall structures showing how the same can be spaced in order to provide an insulating space for exterior walls if desired, each of the wall structures however being a structure in accordance with the present invention.

FIG. 41 shows a plan view showing how wall structures can be connected by connectors to define an insulating space 34 if the same is deemed necessary. Where such a structure is for external walls inner sections of timber could be employed having a different section to that of the weathering wall. A person skilled in the art will appreciate the potential of this system and the fact that with the modular spacing of the holes incremental adjustments of wall thickness can, if desired, be readily achieved.

Figure 42:
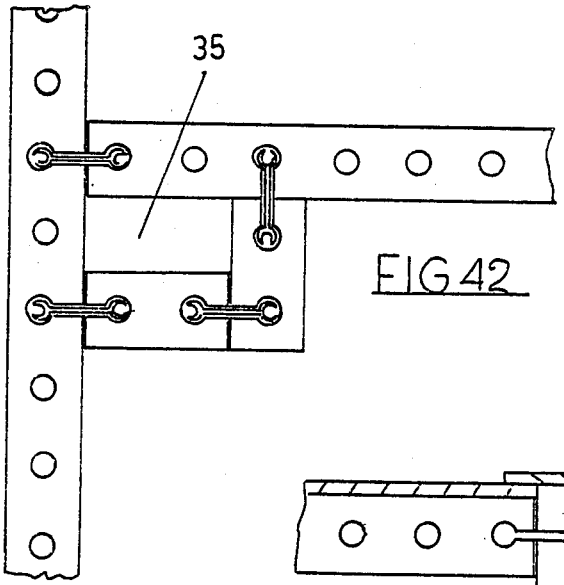
FIG. 42 shows how wall structures can be arranged in order to provide an alternative to a post structure, said alternatives being useful for ducting large diameter utilities in the vertical direction and providing a support frame for the roof.

FIG. 42 shows how it is possible to create a composite post structure formed wholly of horizontally positioned axial lengths of timber or the equivalent that are spline connected to each other to thereby provide a space 35 capable of hiding utilities such as wiring, piping, heating ducts and the like. Such a structure tends to be more time consuming in the erection than the use of a post as shown in FIG. 17 but would find certain applications. Nevertheless FIG. 42 does show how the module is maintained between four walls if the concept shown simplistically there is extrapolated in scale.

Figure 43A:
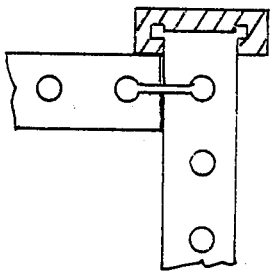
FIGS. 43A and 43B show how an exposed end of a wall can if desired be weather-proofed or dressed.
Figure 44:
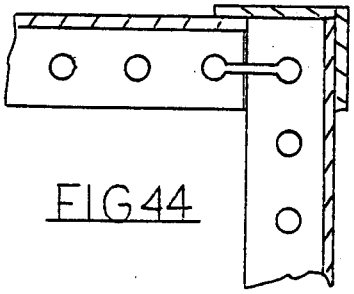
FIG. 44 shows a further variant of the arrangement shown in FIG. 43.

FIGS. 43A and 44 show simply various types of weather cladding in a plan view of external corners of a building. Such forms are not preferably necessary but could be employed.

Figure 43B:
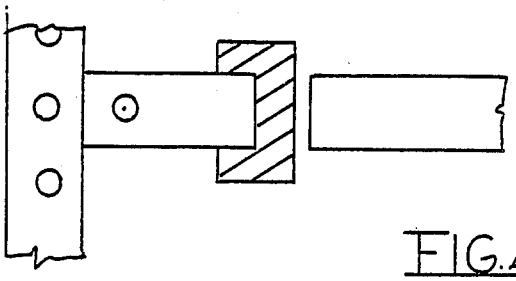

FIGS. 43A could be used internally. FIG. 43B shows the use of such a capping profile as by way of an example a door jamb and as means to tie together a short length of wall.

Figure 45:
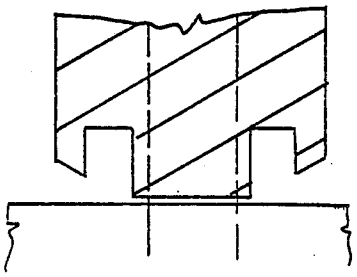
FIG. 45 shows in a similar direction to those shown in FIGS. 2 to 5 how a lower most length of timber or other material in a wall can be rested on the floor or floor joists and can if desired have a dowelling member passed down into a hole in the floor or alternatively can have a tie passed down thereinto.
Figure 46:
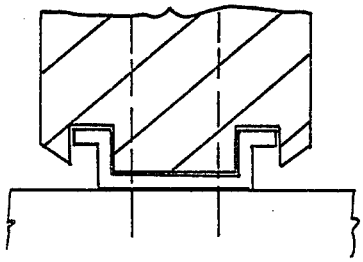
FIG. 46 is a similar view to that of FIG. 45 but showing how an extruded or roll formed metal bracket can locate such a lower most length of timber against movement in a direction which is horizontal yet perpendicular to the elongate axis thereof, again showing in dotted outline the position whereby if desired dowels or tie rod like members can be passed down below the supporting level of the floor or floor joist.

FIG. 45 shows as also does FIG. 46 how a lower most plank or board of a wall structure can be supported by the central tongue region on the surface either in absence of or presence of a metal or the like channel that is affixed to the supporting surface. Moreover in order to firmly anchor the same a tie rod could be passed down some of the holes from at least the ceiling level and also in order to maintain recovery and racking resistance preferably at least one or more tight fit shear members would be passed down into an appropriate hole in the floor.

Figure 47:
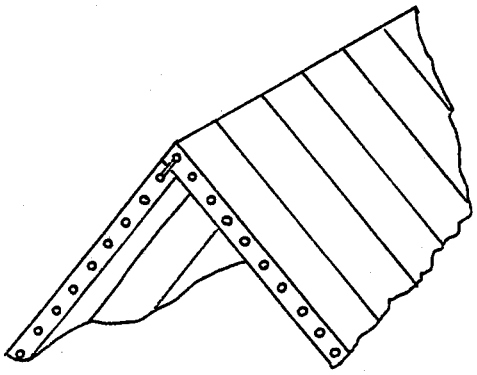
FIG. 47 is a perspective view of a roof structure showing a plurality of lengths of timber in accordance with the present invention which are joined at or about the apex by a spline member in the normal manner described in regard to walls and showing how with the holes of each length of timber lying substantially horizontal how using tie members and dowel members, (the preferred tight fit sheer members) a diaphragm type roof structure can be erected.

FIG. 47 shows how planks or boards in accordance with the present invention can also be used to form a structural roof i.e. the longitudinal axes are inclined so that they provide a mateable right angle joint which can receive a spline member at or about the apex or alternatively provide some form of mitre joint at the apex. Obviously with the provision of tie rods along holes of the structure and also the provision of tight fit shear members between adjacent planks throughout the structure an overall strong structure will be provided. In this form of the invention therefore preferably the holes are indexed to lie substantially horizontal. Persons skilled in the art on the basis of the foregoing will envisage how the modular arrangement of the hole in this way need not necessarily be but can be arranged to bear some modular relationship to structures below the same.

Figure 48:
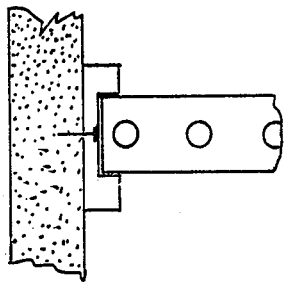
FIG. 48 is a plan view of how a wooden plate or metal channel member can be affixed, for example, by nailing into an existing wall structure e.g. a concrete wall so as to locate the end of a partition wall or the like formed from a plurality of lengths of timber in accordance with the present invention.

FIG. 48 shows how a wall of the kind previously described can be fitted end wise up against an existing for example concrete wall by virtue of a channel of wood, plastic or metal being fixed by appropriate fixing means for example masonry nails into the structure.

Figure 49:
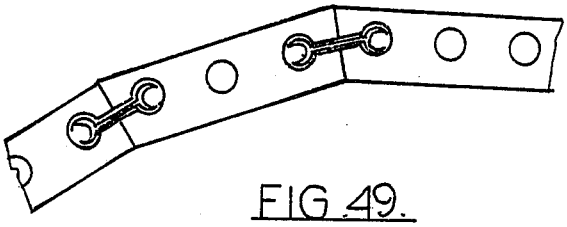
FIG. 49 is a plan view showing how short lengths of timber in accordance with the present invention can be splined together by a variety of mitre or modified joints so as to define a shape suitable for example, below and above a bay window, cylindrical structures, tanks or other curved structures.

FIG. 49 shows how spline members in accordance with the present invention can be used to hold together modified mitre joints so as to define for example a bay window structure or other cylindrical or curved structures. Such a structure would also have application in buildings of unusual configuration. Again however difficulties will be encountered in relating portions of such structure to other walls or structures of the building. Persons skilled in the art however having regard to the foregoing will envisage how that can be arranged.

Figure 50:
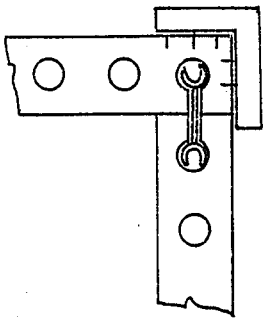
FIG. 50 is a plan view of a corner of a wall showing how the exposed grain of one wall can be protected from the effects of weather using metal or plastic members, the system being an alternative to that shown in FIGS. 43 and 44, the construction of FIG. 50 showing a nailed or screwed in member over which can be clipped the weathering member.

FIG. 50 shows a plan view of an external corner of a building having over the end grain thereof affixed a clip member over which a weatherproof capping of plastic or metal material can be clip fitted. A provision of this two part weather protection on a corner enables the clip member to be affixed by screws or nails and have such unslightly nails or screws covered in an aesthetic yet weatherproof manner.

Figure 51:
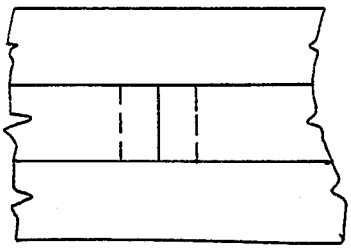
FIG. 51 is a side elevation of a wall structure showing how within a wall structure irrespective of whether or not lengths of timber are not provided with tongues and grooves, how shorter lengths can if desired be butt jointed, the dotted lines showing the extent of a spline member which not only substantially weatherproofs the joint but also makes the joint strong.

FIG. 51 shows how the instance illustrated in FIG. 28 is not necessarily the only instance in a building where a length of spline member substantially only the length of the major transverse distance of a plank would be used. In FIG. 51 is shown a wall where a butt joint owing to a need to join lengths of timber can aesthetically and strongly be mated. This is especially important in instances where some form of weatherproofing should be provided.

Figure 52:
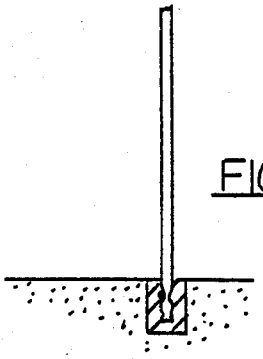
FIG. 52 is a diagrammatic cross-sectional view of a floor, for example, a concrete floor, which has anchored therein any conventional form of concrete socket, for example, a concrete anchor member, and showing how a tie rod or the like of the present invention can be screw engaged therein, (obviously a simple washer and nut arrangement being provided at the upper end (not shown))

FIG. 52 shows a side elevation as previously mentioned of a ground anchoring socket which includes a screw thread into which for example the lower most end of a tie bolt can be screwed after having been passed down through aligned holes of a wall structure. Obviously the upper end thereof would have a washer and nut fitted thereto.

Figure 53:
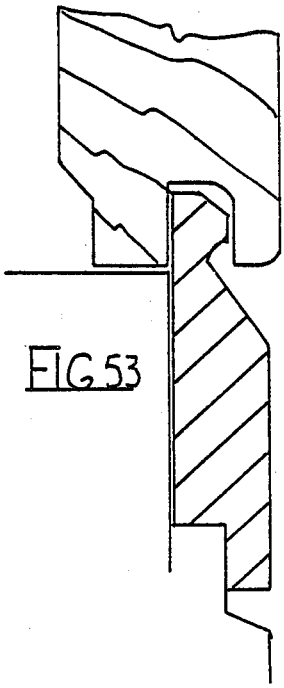
FIG. 53 shows a similar cross-sectional view to that of FIGS. 2 to 5 but showing how at the floor joist level a covering member maintains the appearance of the outer face of the wall below the floor joist level if required.

FIG. 53 shows capping planks or the like which overlie the end plank of a floor joist yet maintain a constant appearance for the facade of the outer wall down below the floor joist level.

Figure 54:
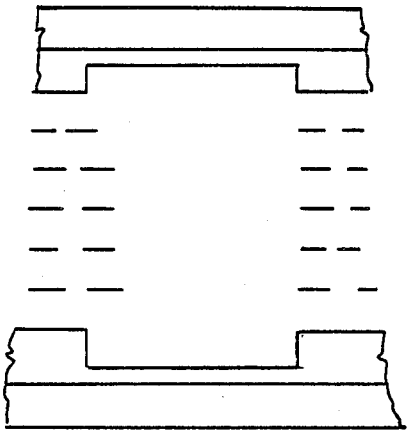
FIG. 54 shows diagrammatically a side elevation of composite members that can be preassembled so as to provide an outline for a window, door or the like opening which minimises the amount of flashing needed, the arrangements shown in solid outline being those that would be preassembled bearing in mind the reduced section which would probably not be self-supporting, FIG. 55 includes sectional views of two possible forms of rafter (see FIG. 38) which are capable of supporting on the shoulders thereof, ceiling linings, soffit lining and the like, FIG. 56 is a similar view to that of FIGS. 2 to 5 but showing how a longitudinal recess can provide means whereby a timber or plastic flashing member for weatherproofing or aesthetic purposes can be engaged therefrom for any number of purposes.

FIG. 54 envisages the coupling together at a factory stage of sections for example as shown in solid outline which can be fabricated on site in order to provide window openings into which window frames which require only a minimum of flashings can be received. The lintel arrangement or the lintel receiving arrangement shown obviously would result in a plank or board being delivered on site which would be too flimsy to withstand breakage and for this reason such a plank having a reduced section would necessarily have to be coupled with a plank of normal strength for example by tight fit shear members and possibly some glue, if the tight fit shear members are not sufficient. Ideally however no glue would be used.

Figure 55:
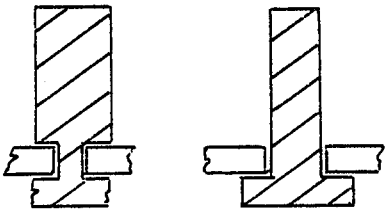

FIG. 55 should be considered in conjunction with FIG. 38 as the same shows possible profiles of rafter members which are provided with shoulders capable of supporting ceiling linings or the like.

Figure 56:
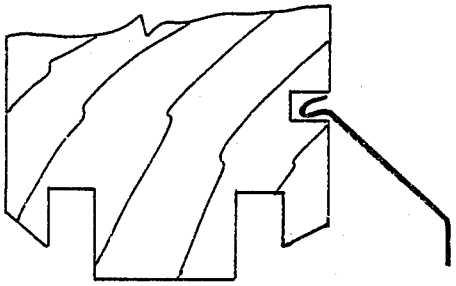
Figure 57:
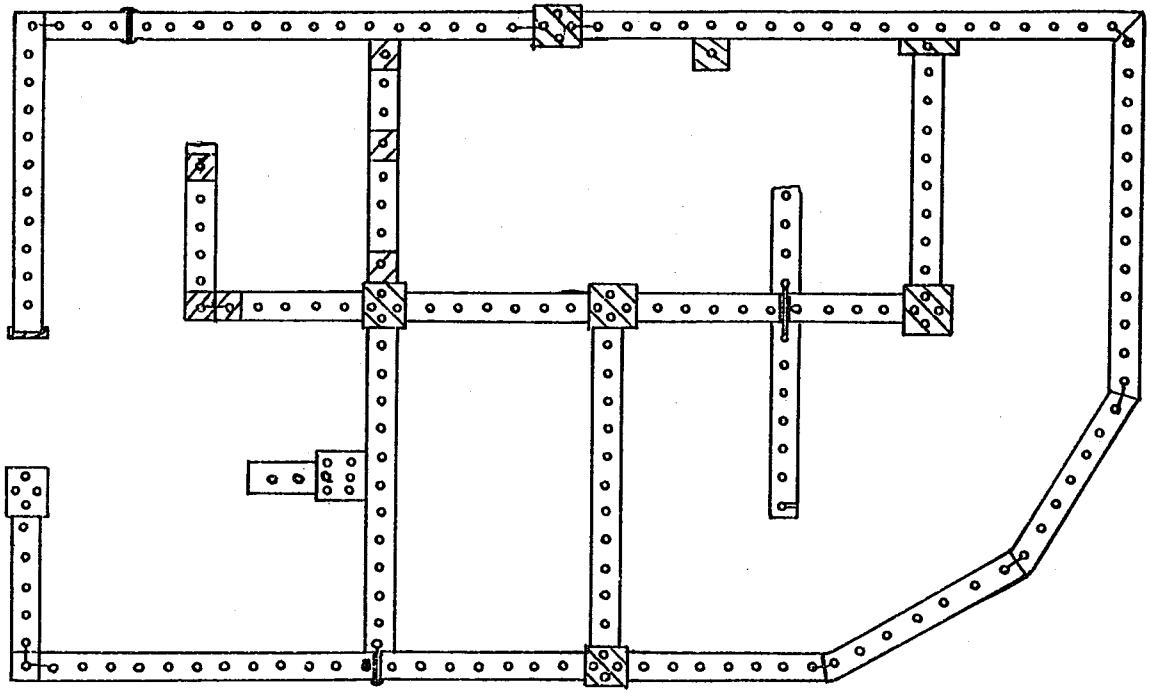
FIG. 57 shows a plan view of a structure showing a multitude of different jointing arrangements but showing how in a majority of instances the modular inter relationship between walls and the like can be maintained, some of the wall structures being of a non plank-like construction so as to show how additions are possible to an existing structure using a building system in accordance with the present invention.

FIG. 56 shows a bottom portion of the profile of the preferred boards showing therein a longitudinal groove capable of receiving a portion at least of a flashing member. Such a flashing member could be a portion of for example skirting, formed from plastics materials, or a metal or could be a portion of a weatherproofing flashing. For example, modifications based on the concept shown in FIG. 56 could have application to window frames etc.

Figure 58:
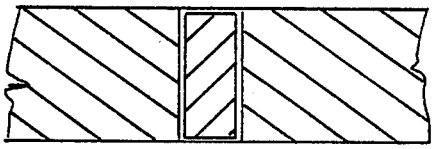
FIG. 58 shows in a sectional view how one of the holes that extends wholly through the transverse section of a plank-like member in accordance with the present invention could have located therein prior to on site location or at least prior to the abutment a shear resisting member which upon said abutment need not be inserted first in the plank-like member shown in FIG. 58 but need only have the shear resisting member pushed threfrom so as to provide the inter engagement with the previously located length, FIG. 59 showing the resulted position in the same terms as shown in FIG. 58.
Figure 59:
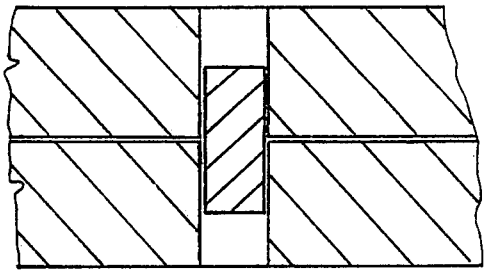

FIGS. 58 and 59 show how if desired shear resisting members such as the preferred dowel can be inserted as required in various holes of the plank-like members prior to their being located on top or alongside as the case may be a prior located elongate component and how the same can be driven into its engagement as shown in FIG. 59 is even envisaged that the planks can be factory prepared with the requiste number of dowel members appropriately positioned for a precut building kit or assembly of components.

For a lower most wall structure the dowel member would be driven down into a floor joist or some foundation dependant member even if it is only a floor and subsequently abutted plank-like members would have their dowel driven down into the abuting plank-like member.

Figure 60:
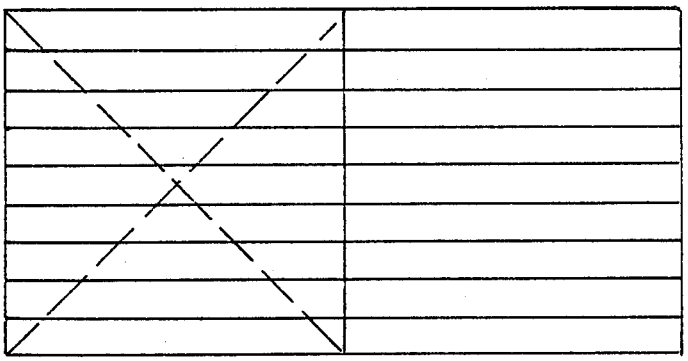
FIG. 60 shows diagramatically a wall section which could wholly or in part be formed in a factory or on site if deemed desirable (though unlikely) which could have sections of the plank-like members glued one to another to provide a rigid section of an overall building structure with probably more resistance to deflection than sections of the building simply provided with the measure of racking resistance that results from the use of the shear resistant members, such a factory or the like prepared structure possibly finding some use in the provision of short walls or the like which even when assembled can be readily man handled on the site.

FIG. 60 shows diagramatically how for example it may be appropriate in a structure to pre-form certain portions of a structure to minimise assembly time on site. This would be especially so where short lengths of wall are used. This therefore lends itself to the possibility of the structural wall components being glued one to another to thus enhance the rigidity of any structure that may otherwise rely for its racking resistance on the dowel and the spline connections etc. The instance as shown in FIG. 60 shows how by way of example a section of a length of wall could if desired, have various portions thereof glued as they are being assembled on site so as to provide a strong point in the structure which otherwise is simply assembled in the nailless fashion in accordance with the preferred form of the present invention.

From the foregoing then it can be seen that the present invention in its most preferred form embodies several important features.

I claim:

1. A method of constructing an essentially one component thick structure of substantially planar walls from contiguous lengths of plank-like building components comprising the steps of producing a plurality of equally spaced parallel holes through each said component, producing slots through each component parallel to said holes and extending from an outer surface of said component where a contiguous component is to be joined to the hole adjacent thereto, placing at least one of said components in position for construction, providing an elongated joining member having the cross-sectional shape of a straight shank with elongated bulbous ends, the dimensions of said shank and bulbous ends being such as to provide a snug sliding fit in said slot and holes respectively, inserting said joining member into at least one of said holes and slot with said shank and one bulbous end in said slot and hole respectively, said joining member also being dimensioned so that when inserted into said hole and slot substantially half of the cross-section of said joining member extends from said component and the length of said joining member extends substantially parallel to the central axis of said hole for a distance comparable to at least one-half the length of said hole, positioning another component with respect to said construction position with the hole and slot thereof in aligned engagement with the extending end of said joining member, sliding said another component into abutting engagement with said first positioned component using said joining member as a guide, inserting wooden dowels into said holes in said another component which are aligned with said holes in previously positioned adjacent components, said dowels having a diameter to provide a snug fit with said holes and a length no greater than the length of a hole, driving said dowels into said aligned holes to effectively provide shear resistance in the finished structure, and continuing said process of assembling and connecting said components until said structure is completed.

2. The method as recited in claim 1 wherein said outer surface of said component is the end of said component and said hole into which said joining member is inserted is an end hole.

3. A method as claimed in claim 2 wherein said plank-like components have mutually parallel outer faces, said equally spaced holes are parallel to and equally spaced from said outer faces, and further comprising spacing said holes a distance X apart with respect to each other and a distance substantially $\frac{1}{2}$X with respect to said parallel faces and to said outer surface so that when assembled a distance of substantially X is maintained between the closest holes of two like components that have been joined together by said joining members.

4. A method as claimed in claim 1 further comprising providing each length-wise abutment between said components with a tongue and groove type engagement and joining said tongue and groove together prior to inserting said dowels.

* * * * *